US006848977B1

(12) United States Patent
Cook et al.

(10) Patent No.: US 6,848,977 B1
(45) Date of Patent: Feb. 1, 2005

(54) POLISHING PAD FOR ELECTROCHEMICAL MECHANICAL POLISHING

(75) Inventors: Lee Melbourne Cook, Steelville, PA (US); David B. James, Newark, DE (US); John V. H. Roberts, Newark, DE (US)

(73) Assignee: Rohm and Haas Electronic Materials CMP Holdings, Inc., Wilmington, DE (US)

( * ) Notice: Subject to any disclaimer, the term of this patent is extended or adjusted under 35 U.S.C. 154(b) by 0 days.

(21) Appl. No.: 10/652,175

(22) Filed: Aug. 29, 2003

(51) Int. Cl.[7] ..... B24B 1/00

(52) U.S. Cl. ..... 451/41; 451/36; 451/288; 451/287; 205/87; 204/212

(58) Field of Search ..... 451/41, 36, 285–288, 451/526, 530, 921; 205/93, 108, 123, 124, 222, 223, 641, 663, 81; 204/212, 217, 224 M, 228.7; 156/345.1; 216/88

(56) References Cited

U.S. PATENT DOCUMENTS

| | | | | |
|---|---|---|---|---|
| 5,256,565 | A | 10/1993 | Bernhardt et al. | |
| 5,575,706 | A | 11/1996 | Tsai et al. | |
| 5,807,165 | A | 9/1998 | Uzoh et al. | |
| 5,911,619 | A | 6/1999 | Uzoh et al. | |
| 5,948,697 | A | 9/1999 | Hata | |
| 6,030,425 | A | 2/2000 | Hata | |
| 6,066,030 | A | 5/2000 | Uzoh | |
| 6,176,992 | B1 | 1/2001 | Talieh | |
| 6,368,190 | B1 * | 4/2002 | Easter et al. | 451/41 |
| 6,379,223 | B1 | 4/2002 | Sun et al. | |
| 6,561,873 | B2 * | 5/2003 | Tsai et al. | 451/36 |
| 6,620,336 | B2 * | 9/2003 | Nakamura | 216/88 |
| 6,736,952 | B2 * | 5/2004 | Emesh et al. | 205/81 |
| 2002/0104764 | A1 | 8/2002 | Banerjee et al. | |
| 2003/0114087 | A1 * | 6/2003 | Duboust et al. | 451/41 |

OTHER PUBLICATIONS

Shih–Chien Chang; Jia–Min Shieh; Chin–Chang Huang; Bau–Tong Dai; Ying–Hao Li; Ming–Shiann Feng, "Microleveling Mechanisms and Application of Electropolishing on Planarization of Copper Metallization", Journal of Vacuum Science & Technology B (Microelectronics and Nanometer Structures), Sep., 2002, pp. 2149–2153, vol. 20, No. 5.

M. H. Tsai; S.W. Chou; C.L. Chang; C.H. Hsieh; M.W. Lin; C.M. Wu; Winston S. Shue; Douglas C. Yu; M.S. Liang, "CMP–Free and CMP–Less Approaches for Multilevel Cu/low–k BEOL Integration", IEDM Technical Digest International, 2001, pp. 4.3.1–4.3.4.

* cited by examiner

*Primary Examiner*—George Nguyen
(74) *Attorney, Agent, or Firm*—Edwin Oh

(57) ABSTRACT

The present invention provides a polishing pad for electrochemical mechanical polishing of conductive substrate. The pad comprises a plurality of grooves formed in a polishing surface of the polishing pad, the grooves being adapted to facilitate the flow of polishing fluid over the polishing pad. The conductive layers are respectively formed in the grooves and are in electrical communication with each other.

10 Claims, 5 Drawing Sheets

POLISHING PAD FOR ELECTROCHEMICAL MECHANICAL POLISHING

BACKGROUND OF THE INVENTION

The invention generally relates to polishing pads for chemical mechanical polishing (CMW), in particular, the invention relates to polishing pads for electrochemical mechanical polishing (ECMP), including methods and systems therefor.

In the fabrication of integrated circuits and other electronic devices, multiple layers of conducting, semiconducting, and dielectric materials are deposited on or removed from the surface of a semiconductor wafer. Thin layers of conducting, semiconducting, and dielectric materials are deposited by a number of deposition techniques. Common deposition techniques include physical vapor deposition (PVD), also known as sputtering, chemical vapor deposition (CVD), plasma-enhanced chemical vapor deposition (PECVD), and electrochemical plating (ECP).

As layers of materials are sequentially deposited and removed, the uppermost surface of the wafer becomes non-planar. Because subsequent semiconductor processing (e.g., lithography) requires the wafer to have a flat surface, the wafer needs to be planarized. Planarization is useful in removing undesired surface topography and surface defects, such as rough surfaces, agglomerated materials, crystal lattice damage, scratches, and contaminated layers or materials.

CMP is a common technique used to planarize substrates such as semiconductor wafers. In conventional CMP, a wafer carrier or polishing head is mounted on a carrier assembly and positioned in contact with a polishing pad (e.g., IC1000™and OXP 4000™ by Rodel of Newark, Del.) in a CMP apparatus. The carrier assembly provides a controllable pressure to the wafer, pressing it against the polishing pad. The pad is optionally moved (e.g., rotated) relative to the wafer by an external driving force (e.g., a motor). Simultaneously therewith, a chemical-based polishing fluid (e.g., a slurry or reactive liquid) is flowed onto the polishing pad and into the gap between the wafer and the polishing pad. The wafer surface is thus polished and made planar by the chemical and mechanical action of the pad surface and polishing fluid.

Presently, there is a demand in integrated circuit (IC) manufacturing for increased densities of wiring interconnects necessitating finer conductor features and/or spacings. Further, there are increasing uses of IC fabrication techniques using multiple conductive layers and damascene processes with low dielectric constant insulators. Such insulators tend to be less mechanically robust than conventional dielectric materials. In manufacturing ICs using these techniques, planarizing the various layers is a critical step in the IC manufacturing process. Unfortunately, the mechanical aspect of CMP is reaching the limit of its ability to planarize such IC substrates because the layers cannot handle the mechanical stress of polishing. In particular, delamination and fracture of the underlayer cap and dielectric material occur during CMP due to frictional stress induced by the physical contact between the polishing substrate and the polish pad.

To mitigate detrimental mechanical effects associated with CMP such as those described above, one approach is to perform ECMP, e.g., using the techniques described in U.S. Pat. No. 5,807,165. ECMP is a controlled electrochemical dissolution process used to planarize a substrate with a metal layer. The planarization mechanism is a diffusion-controlled adsorption and dissolution of metals M (e.g., copper) on the substrate surface by ionizing the metal (to form metal ions M+) using an applied voltage. In performing ECMP, an electrical potential must be established between the wafer and the polishing pad to effectuate electrodiffusion of metal atoms from the substrate metal layer. This can be done, for example, by providing an electrical current to the substrate carrier (anode) and the platen (cathode).

Unfortunately, prior polishing pads are ineffective in supporting the required high current densities of ECMP. Further, conventional polishing pads are ineffective in focusing the electric fields created by the current to increase the efficiency of the ECMP process. Hence, what is needed is a polishing pad for ECMP that overcomes the above noted deficiencies.

STATEMENT OF THE INVENTION

In a first aspect, the present invention is directed to a polishing pad for electrochemical mechanical polishing of a conductive substrate, said pad comprising: a plurality of grooves formed in a polishing surface of the polishing pad, the grooves being adapted to facilitate the flow of polishing fluid over the polishing pad; conductive layers respectively formed in the grooves; and wherein the conductive layers are in electrical communication with each other.

In a second aspect, the present invention is directed to a method of performing electrochemical mechanical polishing of a conductive substrate, the method comprising: providing a polishing pad with a plurality of grooves formed in a polishing surface of the polishing pad, wherein the grooves are adapted to flow a polishing fluid over the polishing pad, and wherein, conductive layers are respectively formed in the grooves, the conductive layers being electrically connected to each other, providing an electrolytic polishing fluid between the substrate and the polishing surface; providing a current to the conductive layers and to the substrate; and pressing the substrate against the polishing surface while moving at least the polishing pad or the substrate.

In a third aspect, the present invention is directed to a system for performing electrochemical mechanical polishing of a conductive substrate, the system comprising: a carrier for supporting a substrate to be polished; a platen for supporting a polishing pad to polish the substrate; a motor for providing relative motion between the carrier and the platen; a feed for providing an electrolytic polishing fluid between the substrate and the polishing pad; a current source electrically connected to the substrate and the polishing pad, and for providing a current therebetween; and wherein the polishing pad comprises: a plurality of grooves formed in a polishing surface of the polishing pad, the grooves being adapted to facilitate flow of the polishing fluid over the polishing pad; conductive layers respectively formed in the grooves; and wherein the conductive layers are in electrical communication with each other.

DETAILED DESCRIPTION OF THE INVENTION

Figure 1:
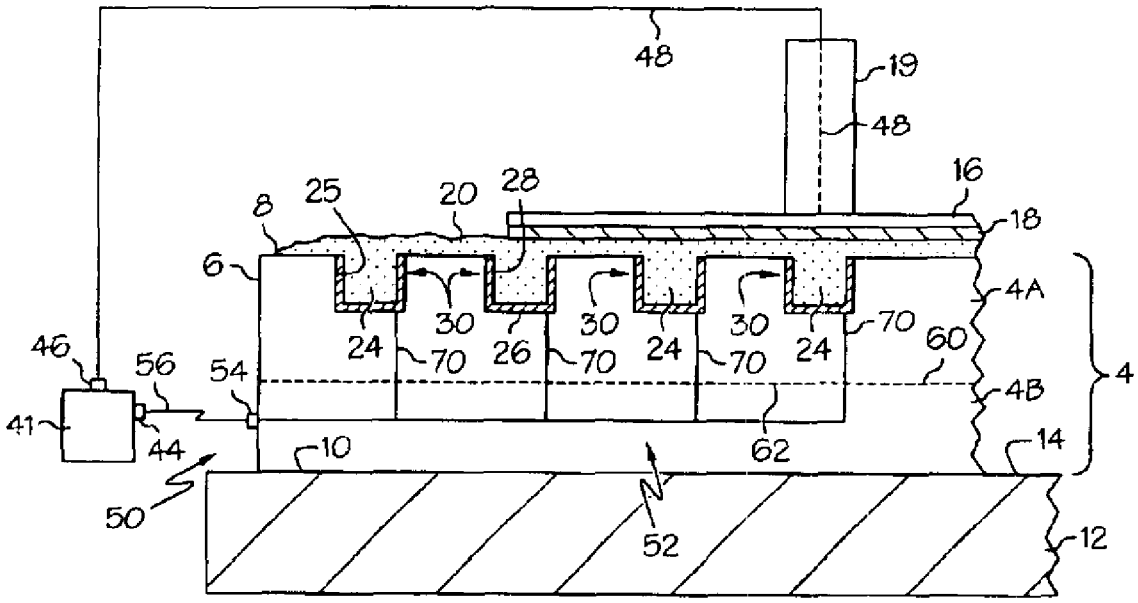
FIG. 1 is a cross-sectional diagram of an exemplary embodiment of the polishing pad of the present invention shown as part of an ECMP system.

Referring to the drawings, FIG. 1 is a cross-sectional diagram of the polishing pad 4 of the present invention, shown as part of an ECMP system. Pad 4 has an upper surface 8 and a lower surface 10. Upper surface 8 serves as the polishing surface. Polishing pad 4 is supported by a platen 12 with an upper surface 14. A substrate (e.g., a wafer) 16 having a metal layer 18 is held in a substrate carrier 19 and positioned in contact with or in very close proximity to pad upper surface 8. An electrolytic polishing fluid 20 is disposed between polishing pad upper surface 8 and substrate metal layer 18.

Polishing pad 4 is made of conventional polishing pad materials, such as polyurethane. In particular, polishing pad 4 can be made of thermoplastic or thermoset materials. For example, pad 4 can be made of nylon, synthetic resin, polyvinylchloride, polyvinylfluoride, polyethylene, polyamide, polystrene, polypropylene, polycarbonates, polyesters, polymethacrylate, and co-polymer, such as acrylonitrile-butadiene-styrene. In an example embodiment, polishing pad 4 has a thickness between 1.5 to 2.5 mm. Also, for example, polishing pad 4 has a modulus value of >25 MPa, a hardness value of >25 Shore D and a compressibility value of <2%.

Grooves 24 are formed in polishing pad 4 each having inner surfaces 25. The plurality of grooves (hereinafter, "grooves") 24 can have any one of a number of shapes and geometries (viewing the pad from the top down), such as spiral, concentric circular, x-y grid, radial, etc. Further, grooves 24 can have any one of a number of cross-sectional shapes, such as v-shaped or u-shaped. Grooves 24 are adapted to facilitate the flow of polishing fluid across the polishing pad.

Grooves 24 include a conductive portion (layer) 26 formed therein and having one or more sides 28. In example embodiments, conductive layer 26 includes one or more of a metal (Al, Cu, W, Ag, Au, etc.), metal alloys, graphite, carbon, and conductive polymers. Conductive layer 26 serves as an electrode (cathode) capable of electrically communicating with conductive matter (e.g., electrolytic polishing fluid 20 or metal layer 18) at or near pad upper surface 8 when a potential is formed between conductive portions 26 and substrate 16. The combination of a groove 24 and the associated conducting layer 26 formed therein constitutes what is referred to hereinafter as a "conducting groove" 30.

Figure 2A:
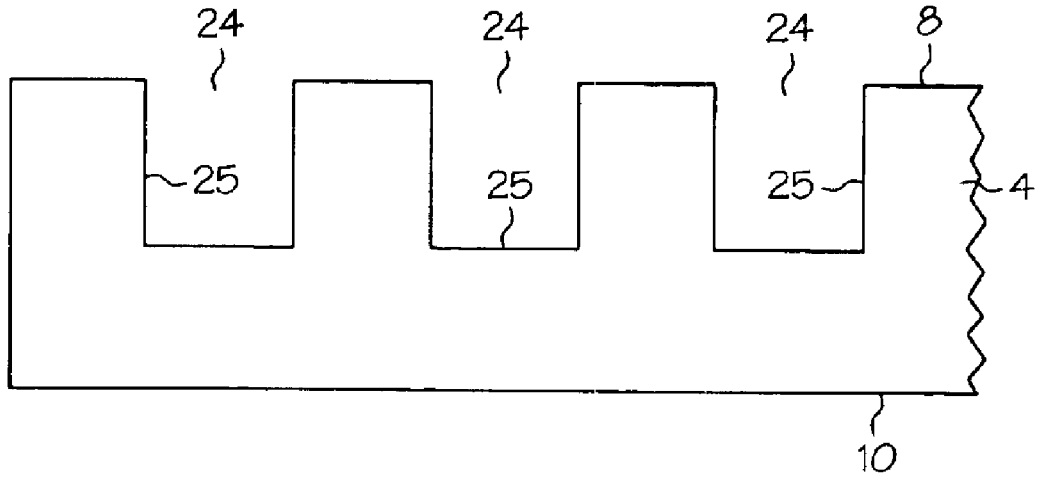
FIGS. 2A–2D are cross-sectional views of an exemplary process for forming the polishing pad of the present invention.

FIGS. 2A–2D are cross-sectional diagrams illustrating an exemplary method for forming the conductive grooves 30 in polishing pad 4. Referring to FIG. 2A, grooves 24 are formed in upper surface 8, e.g., by etching, cutting (e.g., laser-cutting), embossing, or milling the upper surface. In an example embodiment, grooves 24 are formed to have a pitch (i.e., a center-to-center distance between grooves) of between about 0.1 to 25 mm. Further, in an example embodiment, grooves 24 have a width of between about 0.05 to 2.5 mm and a depth of between about 0.1 to 1.5 mm.

Figure 2B:
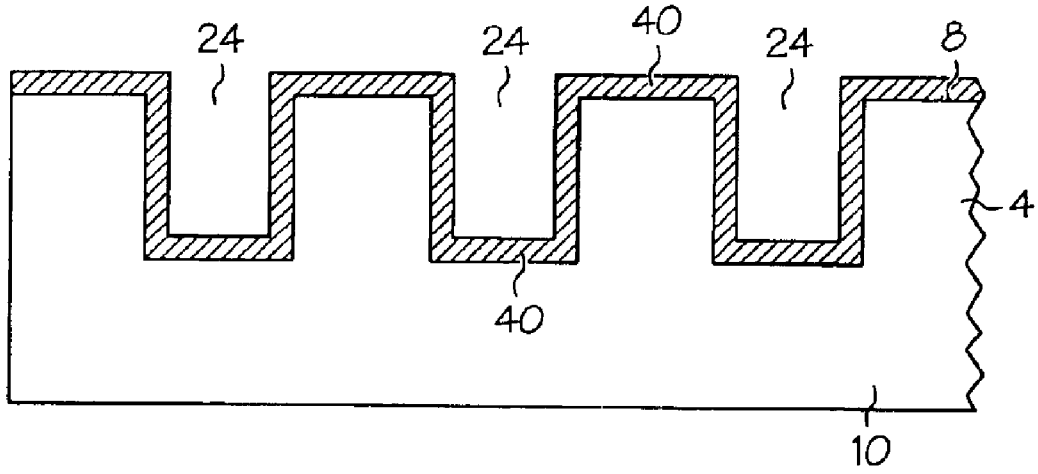

In FIG. 2B, a layer 40 of conductive material is conformally deposited on upper surface 8 covering the inner surfaces 25 of grooves 24. Layer 40 may be formed using any one of the conventional techniques used to form a metal layer on plastic, such as vacuum sputtering, vapor deposition, or deposition of a catalytic coating (e.g., palladium) followed by electroless plating of a metal. Preferred materials for layer 40 include copper, copper-based alloys, carbon, and noble metals such as rhodium, platinum, silver, gold and alloys thereof. Generally, layer 40 is a conductor that can resist the chemical attack during polishing, yet be soft enough to avoid wafer scratching. Layer 40 should be thick enough to handle the current densities used in ECMP processes. In an example embodiment, layer 40 has a thickness in the range of about 10 to 130 microns.

Figure 2C:
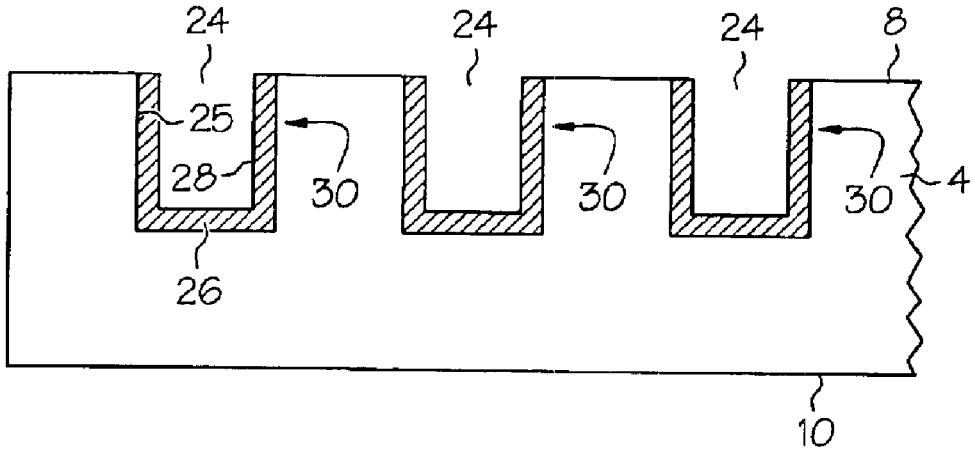
Figure 2D:
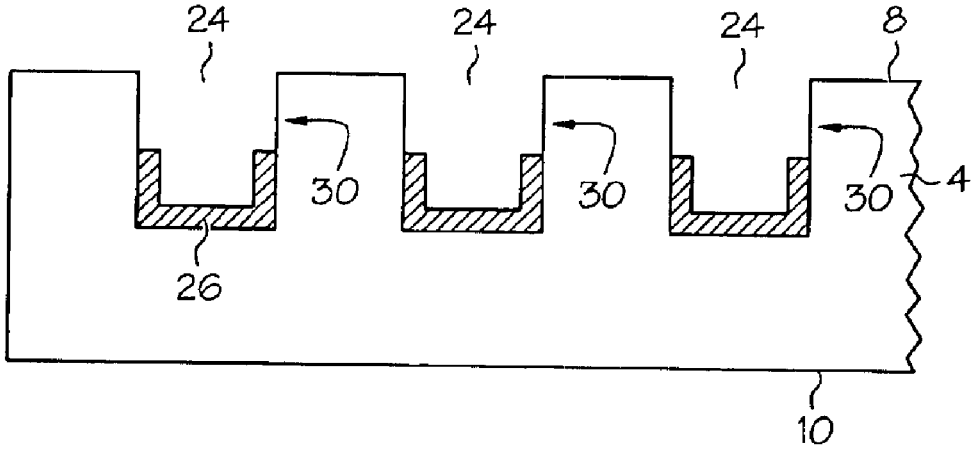

Referring now to FIG. 2C, layer 40 is processed (e.g., polished, conditioned and/or etched) so that only conductive portions 26 within the grooves remain. In this way, the electric fields between the substrate 16 and conductive layer 26, created by the current source 41, are effectively focused. In an example embodiment shown in FIG. 2D, the conductive portions 26 are selectively etched such that conductive portions 26 do not fill the entire groove 24. In other words, only the conductive portions 26 on the top most portion of inner surface 25, closest to the upper surface 8, is removed.

Referring again to FIG. 1, each conductive layer (cathode) 26 is connected to a current source 41 at a negative terminal 44 via an electrical connector system 50. Substrate carrier 19 is connected to current source 41 at a positive terminal 46 via a line 48, effectively making substrate 16 (or more particularly, metal layer 18) serve as an anode. Hence, an electrical connection (circuit) is established between the anode (substrate) and the cathode (conductive layers 26) through electrically conducting polishing fluid 20, or through direct electrical contact with metal layer 18 and conductive layers 26.

In certain types of ECMP systems (rotary polishing systems, orbital polishing systems, linear belt polishing systems and web-based polishing systems), the polishing pad is rotated relative to the current source. Thus, with continuing reference to FIG. 1, the ECMP system illustrated therein includes the aforementioned electrical connector system 50, which is adapted to maintain electrical contact between the conductive grooves 30 and current source 41 even when the polishing pad 4 is moved relative to the current source 41. Electrical connector system 50 is adapted to accommodate the different pad motions associated with the different types or polishing systems. For example, in rotary polishers such as IPEC 472, AMAT Mirra, Speedfam Auriga, Strasburg 6DS, a side-mounted connection, a through-platen connection or an endpoint cable setup is utilized.

In an example embodiment, polishing pad 4 includes an upper layer 4A and a lower layer 4B (shown separated by a dashed line), wherein conductive grooves 30 are formed in the upper layer, and a wiring network 52 as part of an electrical connector system 50, is formed in the lower layer. Wiring network 52 connects conductive grooves 30 to the current source 41. In an example embodiment, these connections are made using an electrical connector 54 and a circumferential lead 56.

Wiring network 52 can be formed using lithographic techniques, wherein a first insulating layer is spin-coated onto an upper surface 60 of pad layer 4B, followed by patterned etch to form trenches arranged to correspond to the particular geometry of conductive grooves 30. The trenches are then filled with a conductive material to form wiring network 52.

Figure 3:
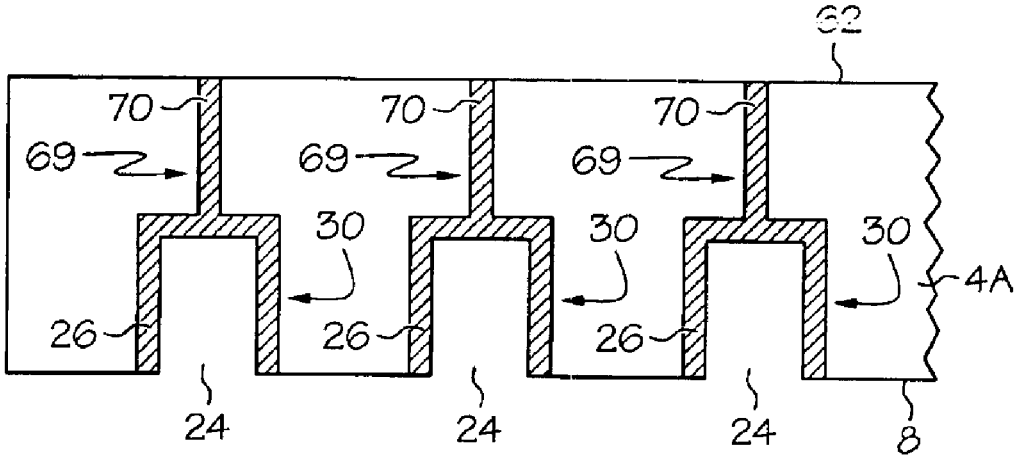
FIG. 3 is a cross-sectional view of an exemplary polishing pad of the present invention having conductive leads formed therein.

Referring to FIG. 3, in an example embodiment, vias 69 are formed in lower surface 62 of pad layer 4A. Vias 69 are then filled with conductive material to form leads 70 connected to respective conductive layers 26 of conductive grooves 30. Upper pad layer 4A and lower pad layer 4B are then interfaced to establish an electrical connection between wiring network 52 and leads 70. Electrical connector 54 is then connected to wiring network 52 and to current source 41.

Figure 4:
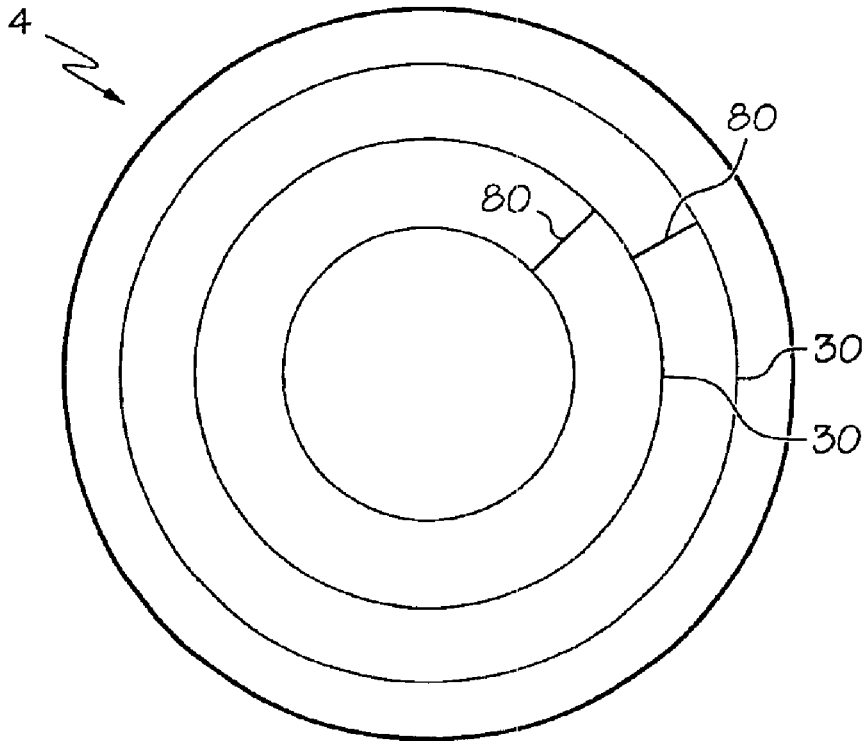
FIG. 4 is a plan view of an exemplary polishing pad of the present invention.

Referring now to FIG. 4, in another example embodiment, the grooves include conducting sub-grooves 80 that link (main) conducting grooves 30. For the example shown in FIG. 4, polishing pad 4 has concentric circular conductive grooves 30 with radial conducting sub-grooves 80 that electrically connect the otherwise electrically isolated concentric conductive grooves 30.

Figure 5:
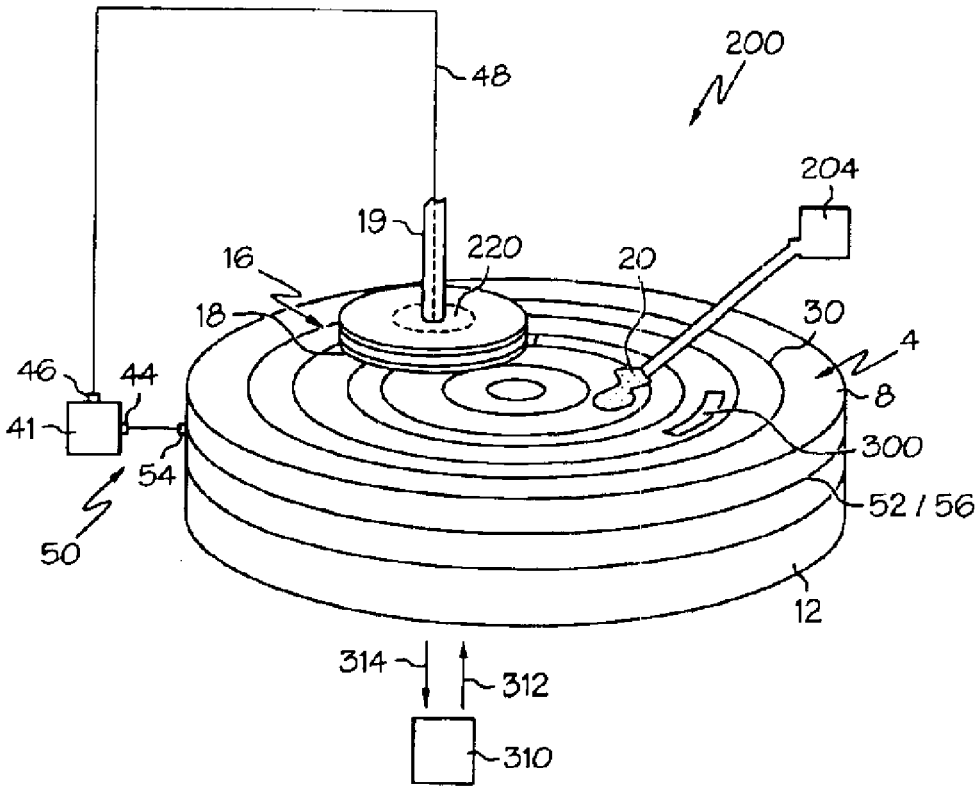
FIG. 5 is a perspective view of another ECMP system utilizing the polishing pad of the present invention.

Referring now to FIG. 5, there is shown a perspective view of an ECMP system 200 that includes the elements of FIG. 1, and further includes a polishing fluid delivery system (feed) 204 for depositing polishing fluid 20. Polishing pad 4 is shown as having circular conductive grooves 30 for illustrative purposes. Further, while CMP system 200 is a rotational system, the principles discussed below apply to other types of CMP systems such as linear or web systems.

In the operation of system 200, substrate (e.g., wafer) 16 is loaded onto substrate carrier 19 and positioned over polishing surface 8. Electrolytic polishing fluid 20 is flowed from polishing fluid delivery system 204 to polishing surface 8 of polishing pad 4. Substrate carrier 19 is then lowered so that substrate 16 is pressed against polishing surface 8. Polishing pad 4 and/or substrate carrier 19 is then put into relative motion, e.g., via rotation of platen 12 and/or the rotation of substrate carrier 19. A current (AC or DC) is flowed from current source 41 to, for example, an anode 220 in substrate carrier 19 via line 48 (e.g., wire) and to electrical connector 54 and wiring network 52 of electrical connector system 50. The proximity of anode 220 to substrate 16 renders metal layer 18 anodic.

When electrolytic polishing fluid 20 makes contact with conductive layer 26 in grooves 24 and with metal layer 18 of substrate 16, an electrical circuit is formed. In response to the negative electrical potential at conductive layers (cathodes) 26, metal ions migrate away from metal layer 18. The metal ion migration effect is localized to those regions of the metal layer closest to conductive layers (cathodes) 26. By placing the substrate in motion relative to polishing surface 8, the migration effect is distributed over the metal layer 18.

The removal rate of metal from metal layer 18 of substrate 16 is partly determined by the current density and current waveform provided by current source 41. Metal layer 18 is ionized by virtue of the electric potential between substrate 16 and conductive grooves 30. The metal ions dissolve into electrolytic polishing solution 20 that flows between polishing surface 8 (including within conducting grooves 30), and metal layer 18. The metal dissolution rate is proportional to the electric current density provided by the current source 41. The electropolishing removal rate increases with higher polishing current density. However, as the current density increases, the probability of damaging microelectronic components formed in substrate 16 increases. In an example embodiment, a current density in the range of about 0.1 to 120 $mA/cm^2$ is used. In an example embodiment wherein a relatively high rate of metal removal is desired, the current density is between about 30 to 120 $mA/cm^2$. In an example embodiment where a relatively low rate of metal removal is desired, the current density is between about 0.1 to 30 $mA/cm^2$.

Because polishing or planarization utilizes an electrochemical reaction, the downward force exerted by substrate carrier 19 is less than that required for performing conventional CMP. Accordingly, the contact friction is less than in conventional CMP, which results in reduced mechanical stress on the exposed metal layer as well as any underlying layers.

In an example embodiment, when initiating the polishing of substrate 16 using ECMP system 200, a relatively high removal rate is used to rapidly remove the bulk metal layer 18. When it is determined (e.g., via optical end-point detection) that most of metal layer 18 is removed (e.g., by detecting breakthrough of the underlying layers), the system parameters are changed to decrease the removal rate. Various current wave-forms (e.g., pulse, bipolar pulse, variable magnitude pulse, continuous current, constant voltage, alternating polarity, modified sine-wave, and others) generated by current source 41 are then used to polish or planarize the thickness variation created during electroplating. In example embodiments, different current densities and waveforms are used in conjunction with localized metal migration to smooth out the otherwise uneven deposition of metal on the substrate.

Often, metal layer 18 is formed via electroplating and has a thickness profile that is thicker at the edge than at the center. Thus, in an example embodiment, the removal rate of metal from the metal layer is varied over metal layer 18 by providing different amounts of current to the conductive grooves, depending on their location. In particular, selective metal removal is accomplished in the example embodiment by defining different polishing pad zones, and applying a different current to the conductive grooves in each zone. In an example embodiment, the applied current is provided in proportion to the metal layer thickness profile.

In an example embodiment, only substrate carrier 19 is rotated to reduce polishing non-uniformity. In another example embodiment, only platen 12 is rotated. Further, in another example embodiment, both substrate carrier 19 and platen 12 are rotated.

With continuing reference to FIG. 5, in an example embodiment, polishing pad 4 includes a transparent window 300 and system 200 includes an optical endpoint detection system 310 in optical communication with substrate 16 through the window. An example of an optical endpoint detection system is the Mirra ISRM system manufactured by Applied Materials, Inc, San Jose, Calif. Detection system 310 transmits a light beam 312 through window 300 to substrate 16 when the window is aligned with system 310 and the substrate. System 310 detects a light beam 314 reflected from the substrate to determine whether the pattern underlying metal layer 18 is exposed. System 310 is coupled to current source 41 and allows for the selective application and control of the current density provided by current source 41 to reduce the damage to any microelectronic components (not shown) embedded within substrate 16.

Endpoint detection is generally used to terminate or alter the polishing process. In an example embodiment, endpoint detection is used in conjunction with controlled current from current source 41 to polish residual metal islands (i.e., portions of metal layer 18 remaining after bulk removal). Use of a high current after "break through" of metal layer 18 can damage electronic components formed in substrate 16. Another technique for performing end-point detection involves monitoring the resistance between substrate 16 and conductive grooves 30 during polishing.

Accordingly, the present invention provides a polishing pad for electrochemical mechanical polishing of a conductive substrate, including methods and systems therefore. The pad comprises a plurality of grooves formed in a polishing surface of the polishing pad, the grooves being adapted to facilitate the flow of polishing fluid over the polishing pad. The conductive layers are respectively formed in the grooves and are in electrical communication with each other. The polishing pads are effective in supporting the required high current densities of ECMP as well as in focusing the electric fields created by the current to increase the efficiency of the ECMP process.

What is claimed is:

1. A polishing pad for electrochemical mechanical polishing of a conductive substrate, said pad comprising:

a plurality of grooves formed in a polishing surface of the polishing pad, the grooves being adapted to facilitate the flow of polishing fluid over the polishing pad;

conductive layers respectively formed in the grooves; and wherein the conductive layers are in electrical communication with each other.

2. The polishing pad of claim 1, wherein said conductive layer has a thickness of 10 to 130 microns.

3. The polishing pad of claim 1, wherein the conductive layers comprise materials selected from the group consisting of metals, metal alloys, graphite, carbon, and conductive polymers.

4. The polishing pad of claim 1, wherein the grooves have a pitch of between 0.1 to 25 mm, a width of between 0.05 to 2.5 mm and a depth of between 0.1 to 1.5 mm.

5. The polishing pad of claim 1, further comprising conductive sub-grooves electrically connected to the grooves.

6. The polishing pad of claim 1, wherein said electrical communication is provided through a wiring network, the wiring network further being electrically connected to an electrical connector.

7. The polishing pad of claim 6, wherein the electrical connector is connected to a current source, the current source being capable of providing a current to the conductive layers via the electrical connector and the wiring network.

8. A method of performing electrochemical mechanical polishing of a conductive substrate, the method comprising:

providing a polishing pad with a plurality of grooves formed in a polishing surface of the polishing pad, wherein the grooves are adapted to flow a polishing fluid over the polishing pad, and wherein, conductive layers are respectively formed in the grooves, the conductive layers being electrically connected to each other;

providing an electrolytic polishing fluid between the substrate and the polishing surface;

providing a current to the conductive layers and to the substrate; and pressing the substrate against the polishing surface while moving at least the polishing pad or the substrate.

9. The method of claim 8, wherein the current is between 0.1 to 120 $mA/cm^2$.

10. A system for performing electrochemical mechanical polishing of a conductive substrate, the system comprising:

a carrier for supporting a substrate to be polished;

a platen for supporting a polishing pad to polish the substrate;

a motor for providing relative motion between the carrier and the platen;

a feed for providing an electrolytic polishing fluid between the substrate and the polishing pad;

a current source electrically connected to the substrate and the polishing pad, and for providing a current therebetween; and wherein the polishing pad comprises:

a plurality of grooves formed in a polishing surface of the polishing pad, the grooves being adapted to facilitate flow of the polishing fluid over the polishing pad;

conductive layers respectively formed in the grooves; and wherein the conductive layers are in electrical communication with each other.

* * * * *